US007400086B2

(12) United States Patent
Ishihara et al.

(10) Patent No.: US 7,400,086 B2
(45) Date of Patent: Jul. 15, 2008

(54) SELF-LUMINOUS DISPLAY DEVICE HAVING AN INORGANIC EL ELEMENT LIGHT EMISSION UNIT BETWEEN ELECTRODES

(75) Inventors: Hajime Ishihara, Handa (JP); Yutaka Hattori, Okazaki (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 11/330,110

(22) Filed: Jan. 12, 2006

(65) Prior Publication Data

US 2006/0170333 A1 Aug. 3, 2006

(30) Foreign Application Priority Data

Jan. 31, 2005 (JP) ..... 2005-022550

(51) Int. Cl.
*H01J 63/04* (2006.01)

(52) U.S. Cl. ..... 313/503; 313/498

(58) Field of Classification Search ..... 313/503, 313/504–506, 498; 315/169.1, 169.3
See application file for complete search history.

(56) References Cited

U.S. PATENT DOCUMENTS 4,721,631 A * 1/1988 Endo et al. ..... 427/66
4,924,144 A * 5/1990 Menn et al. ..... 313/505
5,479,070 A * 12/1995 Murakami ..... 313/499
5,892,323 A * 4/1999 Zimmerman ..... 313/495
6,037,005 A * 3/2000 Moshrefzadeh et al. ..... 427/286
6,054,809 A * 4/2000 Haynes et al. ..... 313/505
6,501,846 B1 * 12/2002 Dickinson et al. ..... 382/124
6,566,806 B1 * 5/2003 Kawai ..... 313/504
6,583,582 B2 * 6/2003 Ichikawa ..... 315/169.3
6,633,122 B2 * 10/2003 Kijima et al. ..... 313/506
6,727,647 B2 * 4/2004 Fukuda et al. ..... 313/506
2002/0028348 A1 * 3/2002 Tao et al. ..... 428/690
2002/0036463 A1 * 3/2002 Yoneda et al. ..... 313/506
2004/0150979 A1 * 8/2004 Lambertini et al. ..... 362/31
2004/0183082 A1 * 9/2004 Yamazaki ..... 257/79
2004/0239258 A1 12/2004 Seki

FOREIGN PATENT DOCUMENTS

JP 2002-350831 12/2002
JP 2003-057668 2/2003
JP 2003-075852 3/2003

OTHER PUBLICATIONS

Office Action dated Jul. 27, 2007 issued in corresponding Chinese Application No. 200610004795.9.

* cited by examiner

*Primary Examiner*—Joseph L. Williams
*Assistant Examiner*—Hana A Sanei
(74) *Attorney, Agent, or Firm*—Nixon & Vanderhye P.C.

(57) ABSTRACT

A self-luminous display device includes emission pixels which are formed by sandwiching, through insulator layers, an emission layer between first and second electrodes. Holes are opened and arranged regularly in at least one of the first and second electrodes. The open sizes of the holes may be equal to or smaller than 50 μm, and may be smaller than 20 μm. Therefore, the self-luminous display device can be operated with a low power consumption.

30 Claims, 4 Drawing Sheets

SELF-LUMINOUS DISPLAY DEVICE HAVING AN INORGANIC EL ELEMENT LIGHT EMISSION UNIT BETWEEN ELECTRODES

CROSS REFERENCE TO RELATED APPLICATION

This application is based on and incorporates herein by reference Japanese patent application No. 2005-22550 filed on Jan. 31, 2005.

FIELD OF THE INVENTION

The present invention relates to a self-luminous display device including an emission pixel formed by inserting an emission unit between a pair of electrodes.

BACKGROUND OF THE INVENTION

Among various display devices such as a CRT, a LCD, a PDP (plasma display panel), and an EL (electroluminescence) display, a self-luminous display device such as the PDP and the EL display is superior in quality of displayed images.

However, the self-luminous display device consumes much electric power and it is necessary to lower its power consumption in order to reduce its negative influence to the environment and its running cost. In particular, necessity for reducing the power consumption increases as the size of the display device becomes larger.

Here, the necessity for reducing the power consumption is described in view of an emission mechanism of the self-luminous display device, with reference to an inorganic EL display device shown in FIG. 7 as an example of the self-luminous display device.

As shown in FIG. 7, the inorganic EL display device normally has a double insulating structure in which an emission layer 40 operated as an emission unit is inserted between insulating layers 30 and 50 and between electrodes 20 and 60*a*. The electrode 20 is on a substrate 10.

The insulating layers 30, 50 and the emission layer 40 are electrically capacitive loads. When alternating voltage is applied between the electrodes 20 and 60*a*, electric charge is stored by an amount depending on capacitances of the emission layer 40 and the insulating layers 30 and 50.

When the applied voltage exceeds a clamping voltage which depends on composition and film thickness of the emission layer 40 and the insulating layers 30 and 50, the stored charge flows in the emission layer 40 and collides with an emission core of the emission layer 40 to excite the emission core. The excited emission core emits light when its energy level drops to a ground state.

Since the inorganic EL display device is a capacitive load, electric current is generated with intensity depending on the capacitances of the emission layer 40 and the insulating layers 30 and 50, in storing and discharging the electric charge. In addition, the electric current is generated when the emission layer 40 emits the light in the emission mechanism described above. Therefore, the power consumption of the inorganic EL display increases as a display area becomes larger, because the capacitances of the elements 30, 40 and 50 increase as the display area becomes larger.

Therefore, in order to make the inorganic EL display achieve a large display area, a low operating voltage and a high brightness, it is necessary to reduce the power consumption. The necessity of reducing the power consumption is not specific to the inorganic EL display and is common to the self-luminous display device.

SUMMARY OF THE INVENTION

It is therefore an object of the present invention to achieve low power consumption in a self-luminous display device including an emission pixel formed by inserting an emission unit between a pair of electrodes.

A self-luminous display device according to the present invention includes an emission pixel formed by inserting an emission unit between a pair of electrodes, and holes are opened and arranged in a predetermined pattern in at least one of the electrodes.

By arranging the open holes regularly in at least one of the electrodes, the total area of the emission pixel is decreased. Decreasing of the total area of the emission pixel also lowers a capacitance of the emission pixel. Therefore, power consumption of the self-luminous display device is reduced.

Positions corresponding to the holes do not emit light, because voltage is not applied to the positions. The positions, however, look like emitting the light because the light emitted at a vicinity of each of the holes is scattered by asperity of the emission unit.

Therefore, the low power consumption is properly achieved in the self-luminous display device including the emission pixel formed by sandwiching the emission unit between a pair of electrodes.

The electrodes and the emission unit can be disposed to form a plurality of emission pixels arranged in a segment displaying pattern, or can be disposed to form a plurality of emission pixels arranged in a dot-matrix displaying pattern.

BRIEF DESCRIPTION OF THE DRAWINGS

The invention, together with additional objective, features and advantages thereof, will be best understood from the following description, the appended claims and the accompanying drawings. In the drawings:

DETAILED DESCRIPTION OF THE EMBODIMENTS

Hereafter, an embodiment of the present invention is described with reference to FIGS. 1-3.

Figure 1:
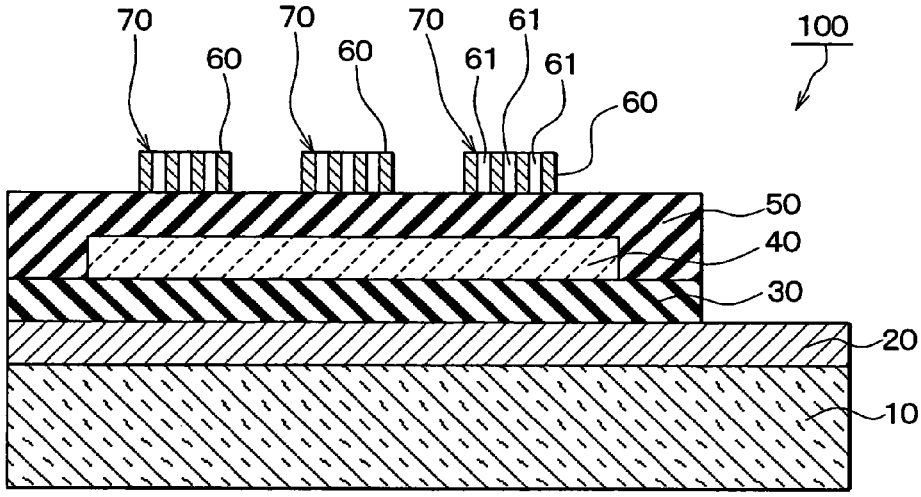
FIG. 1 is a schematic cross-sectional view showing an inorganic EL display device as a self-luminous display device according to an embodiment of the present invention.

As shown in FIG. 1, an inorganic EL display device 100 according to this embodiment is an inorganic EL element formed by stacking thin films 20-60 in layers on a glass substrate 10.

First electrodes 20 are formed on the glass substrate 10 as lower electrodes under an emission layer 40. Each of the first electrodes 20 is optically transparent and can be made of, for example, an ITO (indium-tin oxide) film or a zinc oxide film. In this embodiment, each of the first electrodes 20 is made of the ITO film.

A first insulator layer 30 is formed on the first electrodes 20. The first insulator layer 30 may be made of, for example, a tantalum pentoxide ($Ta_2O_5$) film or an ATO film ($Al_2O_3$/$TiO_2$ laminated film) which is a laminated film of $Al_2O_3$ and $TiO_2$. In this embodiment, the first insulator layer 30 is made of the $Al_2O_3$/$TiO_2$ laminated film.

An emission layer 40 is formed on the first insulator layer 30 as an emission unit, which is mainly made of inorganic EL material. The emission layer 40 is made of, for example, a II-VI compound semiconductor to which an emission core, for example, rare earth element is added.

The II-VI compound semiconductor is a compound of material (like Ca, Sr, Zn, and Cd) belonging to the group IIA or IIB of the old-fashioned periodic system (the group 2 or 12 of the current periodic system) and material (like O and S) belonging to the group VIB of the old-fashioned periodic system (the group 16 of the current periodic system).

Specifically, the emission layer 40 may be made of a base material composed of at least one of the ZnS, SrS, and CaS, and the emission core like manganese (Mn) element or rare earth element (e.g. terbium (Tb) and samarium) in the base material. In this embodiment, the emission layer 40 is constructed with a film made of a zinc sulfide and manganese (ZnS:Mn) compound in which the base material is composed of ZnS and the emission core is composed of Mn.

Surface roughness Ra of the emission layer 40 may be equal to or larger than 10 nm. The surface roughness Ra is defined by JIS (Japanese Industrial Standards).

A second insulator layer 50 is formed on the emission layer 40. The second insulator layer 50 may be made of, for example, an ATO film or a tantalum pentoxide film which are described above. In this embodiment, the second insulator layer 50 is made of the $Al_2O_3$/$TiO_2$ laminated film.

Second electrodes 60 are formed on the second insulator layer 50 as upper electrodes above the emission layer 40. Each of the second electrodes 60 is optically transparent and may be made of, for example, an ITO (indium-tin oxide) film or a zinc oxide film. In this embodiment, each of the second electrodes 60 is made of the ITO film and has a thickness of about 200 nm.

Each of emission pixels 70 operated as a display area includes a portion of the first electrodes 20 and a portion of the second electrodes 60 which overlap each other, and further includes portions of the first insulator layer 30, the emission layer 40, and the second insulator layer 50 sandwiched between the overlapping portions of the first and second electrodes 20 and 60.

In this embodiment, the first electrodes 20 are arranged to form a first group of stripes, whereas the second electrodes 60 are arranged to form a second group of stripes which are perpendicular to the stripes belonging to the first group. Therefore, the emission pixels 70, each of which includes an overlapped portion of the first electrodes 20 and the second electrodes 60, are arranged in a reticular pattern. In other words, the emission pixels 70 are arranged in a dot matrix displaying pattern.

The emission pixels 70 can emit light when electric voltage is applied between the first electrodes 20 and the second electrodes 60. As described above, the inorganic EL display device 100 includes the emission pixels 70 formed by sandwiching the emission layer 40 as an emission unit between the first electrodes 20 and the second electrodes 60.

In this embodiment, since the first and second electrodes 20 and 60 are optically transparent, the emitted light can be received from both the sides of the glass substrate 10 and the second electrode 60 of the inorganic EL display device 100.

Figure 2:
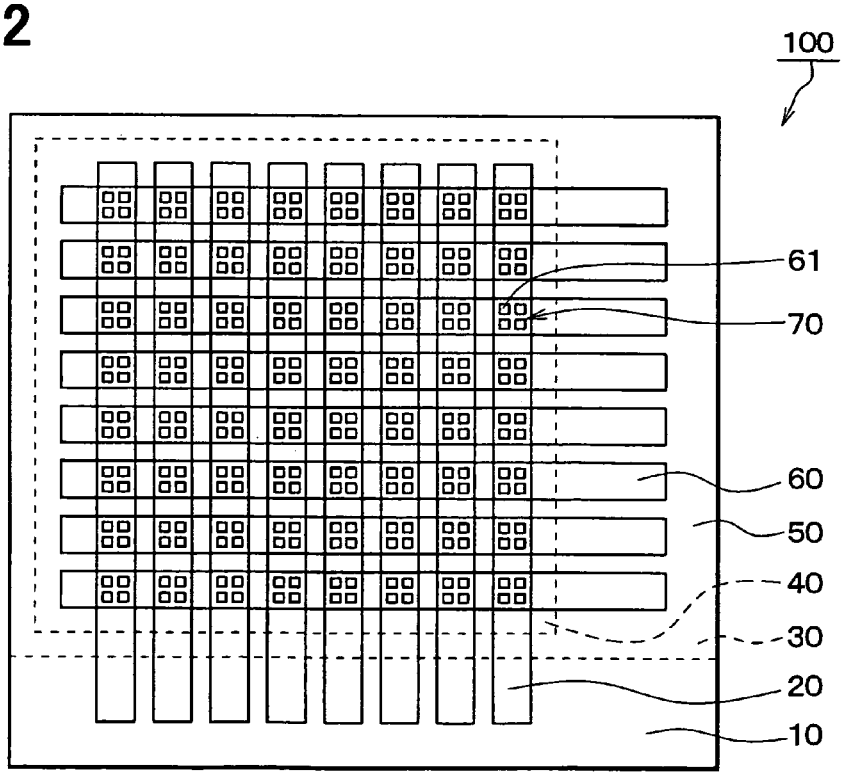
FIG. 2 is a schematic top view showing the inorganic EL display device.
Figure 3:
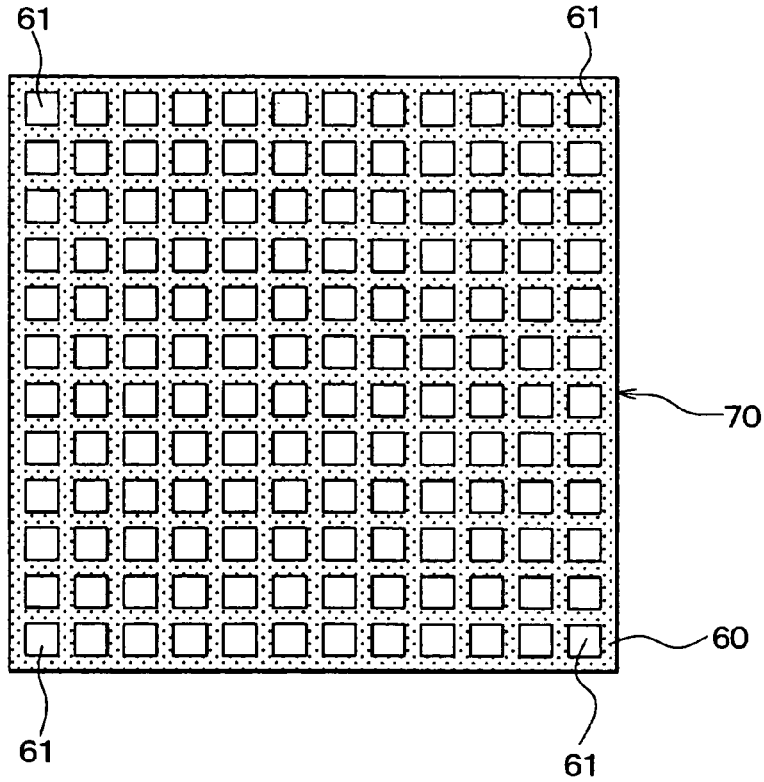
FIG. 3 is an enlarged view showing an emission pixel of the inorganic EL display device.

As shown in FIGS. 1-3, multiple holes 61 are opened in each portion of the second electrodes 60 to form the emission pixels 70.

In FIGS. 1 and 2, the holes 61 are not drawn to scale and are shown larger for illustration purposes. Detailed arrangement of the holes 61 is shown in FIG. 3.

As shown in FIG. 3, the holes 61 are regularly arranged in a predetermined pattern (e.g., in the dot matrix displaying pattern). The holes 61 are not limited to be arranged in the dot matrix displaying pattern, and can be arranged in the other patterns.

Every open size of the holes 61 may be equal to or smaller than 50 μm, and may be equal to or smaller than 20 μm. An average open size of the holes 61 may be smaller than 50 μm, and may be smaller than 20 μm.

A total area of the emission pixels 70 excluding the areas of the holes 61 may be equal to or more than 25% of a total area of the emission pixels 70 including the areas of the holes 61.

Each of the holes 61 may have a shape of a circle or a polygon. The open size of each hole 61 can be measured in a normal manner. For example, the open size is a diameter of each hole 61 if the hole 61 has a circular shape, and is a diagonal length of each hole 61 if the hole 61 has a polygonal shape. The holes 61 do not need to be arranged in a manner shown in FIG. 3.

Next, a manufacturing method for the inorganic EL display device 100 according to the embodiment is described.

First, the optically transparent ITO films as the first electrodes 20 are formed on the glass substrate 10 by using a sputter technique. The first electrodes 20 may be formed as a pattern by photolithography and etching.

Next, the $Al_2O_3$/$TiO_2$ laminated film as the first insulator layer 30 is formed on the first electrodes 20 by using an ALD (Atomic Layer Deposition) method. Specifically, a method for forming the $Al_2O_3$/$TiO_2$ laminated film includes steps as follows.

In the first step, an $Al_2O_3$ sub-layer is formed by the ALD method, using aluminum trichloride ($AlCl_3$) as ingredient gas for aluminum (Al) and water ($H_2O$) as ingredient gas for oxygen (O).

In the ALD method, the ingredient gas for the aluminum and the ingredient gas for the oxygen are alternately supplied, in order to form the sub-layer by stacking piece by piece sub-films each having thickness of a single atom. In this case, the $AlCl_3$ gas is introduced into a reactor by means of Ar carrier gas made of argon (Ar) for one second and subsequently gas in the reactor is purged for a period sufficient for discharging the $AlCl_3$ gas in the reactor.

Next, the $H_2O$ gas is likewise introduced into the reactor by means of the Ar carrier gas for one second and subsequently gas in the reactor is purged for a period sufficient for discharging the $H_2O$ gas in the reactor. By repeating a cycle of introducing the $AlCl_3$ gas and the $H_2O$ gas, the $Al_2O_3$ sub-layer with a predetermined thickness is formed.

In the second step, a titanium dioxide sub-layer is formed by the ALD method, using titanium tetrachloride ($TiCl_4$) as ingredient gas for titanium (Ti) and water ($H_2O$) as ingredient gas for oxygen (O).

Specifically, in a similar manner to the first step, the $TiCl_4$ gas is introduced into the reactor by means of the Ar carrier gas for one second and subsequently the gas in the reactor is purged for a period sufficient for discharging the $TiCl_4$ gas in the reactor. Next, the $H_2O$ gas is likewise introduced into the reactor by means of the Ar carrier gas for one second and subsequently the gas in the reactor is purged for a period sufficient for discharging the $H_2O$ gas in the reactor. By repeating a cycle of introducing the $TiCl_4$ gas and the $H_2O$ gas, the titanium dioxide sub-layer with a predetermined thickness is formed.

By repeating the first step and the second step alternately, the $Al_2O_3/TiO_2$ laminated film is formed as the first insulator layer 30. The thickness of each of the $Al_2O_3$ sub-layers and the $TiO_2$ sub-layers formed by the process may be 5 nm. Each of the numbers of the $Al_2O_3$ sub-layers and the $TiO_2$ sub-layers in the first insulator layer 30 may be thirty.

The first sub-layer and the last sub-layer of the $Al_2O_3/TiO_2$ laminated film may be an $Al_2O_3$ sub-layer or a $TiO_2$ sub-layer. The first (bottom) sub-layer closest to the first electrodes 20 may be the $Al_2O_3$ sub-layer.

When a film having a thickness corresponding to a size of an atom is formed by using the ALD method, the film does not function as an insulator layer if sub-layers in the film are thinner than 0.5 nm, whereas voltage resistance effect due to a laminated structure is relatively reduced if the sub-layers in the film is thicker than 20 nm. Therefore, it is preferable that the thickness of sub-layers in the laminated film is within a range from 0.5 nm to 20 nm, more preferably, within a range from 1 nm to 10 nm.

Next, on the first insulator layer 30, the emission layer 40 is formed, by using an evaporation method. That is, as the emission layer 40, a film is formed by the evaporation method using the zinc sulfide and the manganese (ZnS:Mn) compound in which the base material is composed of the ZnS and the emission core is composed of Mn.

Subsequently, the second insulator layer 50 is formed on the emission layer 40 to have the same structure and thickness as the first insulator layer 30. Finally, the ITO film is formed on the second insulator layer 50 as the second electrodes 60 in the same manner as the first electrodes 20.

The second electrodes 60 can be formed to have a predetermined pattern by photolithography and etching. The holes 61 can be formed simply by modifying a pattern of a mask used in this photolithography from a stripe pattern for the second electrodes 60 to a pattern for the holes 61. Therefore, additional manufacturing process is unnecessary for the holes 61. Thus, the inorganic EL display device 100 can be formed through the above steps.

Since the second electrodes 60 are arranged regularly (in a matrix pattern in FIG. 3) in each of the emission pixels 70, a total area of each emission pixel 70 excluding a total area of the holes 61 is reduced. When the total area of the emission pixels 70 are reduced, element capacitances of the emission pixels 70 are reduced and therefore power consumption of the inorganic EL display device 100 is reduced.

Light is not emitted from positions corresponding to the holes 61, because voltage is not applied to the positions. The positions, however, look like emitting light because light emitted at a vicinity of each of the holes 61 is scattered by asperity of the emission layer 40.

Therefore, the low power consumption is properly achieved in the inorganic EL display device 100 including the emission pixels 70 formed by sandwiching the emission layer 40 between the first and second electrodes 20 and 60.

According to studies of inventors, in the case that the open sizes of the holes 61 are equal to or smaller than 50 μm, contrast is small between an unremitting portion of the emission pixels 70 which is not emitting light and an emitting portion of the emission pixels 70 which is emitting light. Therefore, it is hard to recognize the holes 61.

Figure 4:
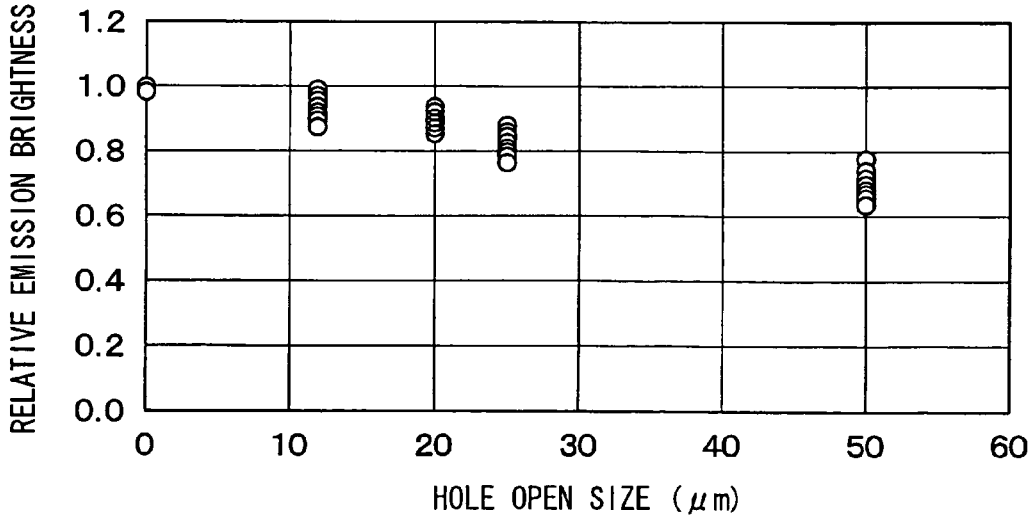
FIG. 4 is a graph showing a relation between an open size of a hole and a relative emission brightness.

Relative emission brightness in FIG. 4 is a ratio of emission brightness of one of the emission pixels 70 having the holes 61 to emission brightness of an emission pixel having no hole. The open sizes of the holes 61 can be easily changed by adjusting open sizes of open mouths of the mask.

As shown in FIG. 4, the relative emission brightness becomes smaller as the open size of one of the hole 61 becomes larger. This seems to come from a fact that scattered light from a position of the hole 61 has become fainter because of damping, when the open size of the hole 61 becomes larger and an interval between an edge of a portion emitting light and the center of the hole 61 becomes larger.

According to studies of the inventors, in the case that the open size of the hole 61 becomes larger than 100 μm, the contrast becomes significant between the emitting portion of the emission pixels 70 and the unremitting portion of the emission pixels 70, and the hole 61 can be recognized with naked eyes.

In contrast, in the case that the open size of the hole 61 is smaller than 50 μm, the contrast becomes small and the hole 61 cannot be recognized with naked eyes. Therefore, it is not necessary to consider, in manufacturing of the inorganic EL display device 100, visual effects originating from the existence of the hole 61.

As shown in FIG. 4, in the case that the open size of the hole 61 is equal to or smaller than 20 μm, the hole 61 cannot be recognized with naked eyes and the relative emission brightness can be made more than 0.8. Thus the hole 61 with the open size smaller than 20 μm suppresses a decrease of the emission brightness due to the existence of the hole 61 to a satisfactory amount for a practical use.

In the case that the total area of the emission pixels 70 excluding the areas of the holes 61 is more than 25% of the total area of the emission pixels 70 including the areas of the holes 61, the emission brightness of the inorganic EL display device 100 is hardly reduced regardless of the number of the holes 61.

Figure 5:
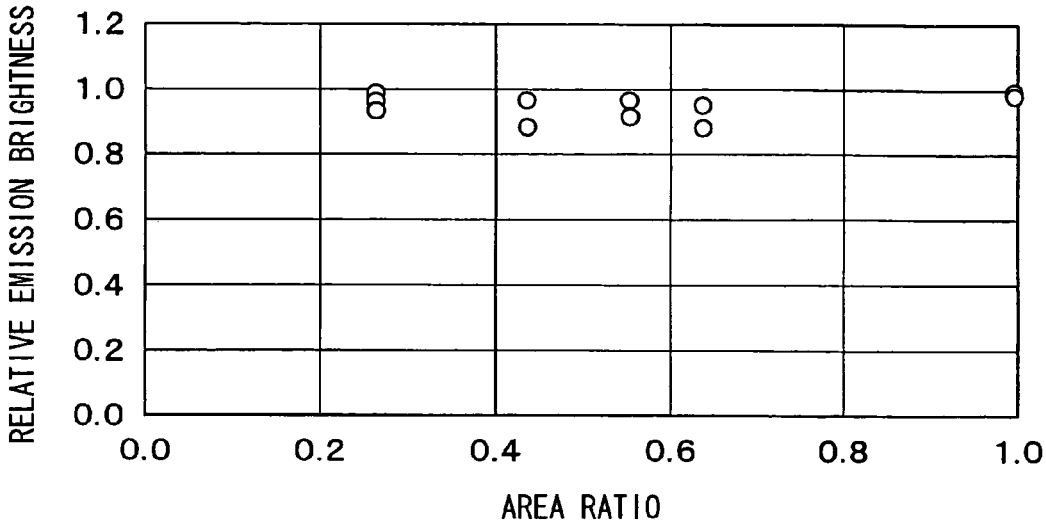
FIG. 5 is a graph showing a relation between an area ratio and the relative emission brightness.

This can be seen in FIG. 5, which shows a relation between an area ratio and the relative emission brightness of the emission pixels 70. In FIG. 5, the area ratio is a ratio of the total area of the emission pixels 70 excluding the areas of the holes 61 to the total area of the emission pixels 70 including the areas of the holes 61.

Here, the smaller this area ratio becomes, the more the number of the holes 60 in the emission pixels 70 becomes. In FIG. 5, the open sizes of the holes 61 are 12 μm.

As shown in FIG. 5, as long as this area ratio is equal to or more than 25%, the total area of the emission pixels 70 excluding the areas of the holes 61 can be reduced without substantially reducing the emission brightness of the emission pixels 70, and thereby the amount of the power consumption of the emission pixels 70 can be reduced.

As described above, each of the emission pixels 70 is formed as a portion of the inorganic EL display device 100 where one of the first electrodes 20 and one of the second electrodes 60 arranged in a striping pattern intersect with each other. In addition, the emission pixels 70 can be arranged in a dot matrix displaying pattern.

In the inorganic EL display device, when the surface roughness Ra of the emission layer 40 is larger than 10 nm, the emission brightness is hardly changed.

Figure 6:
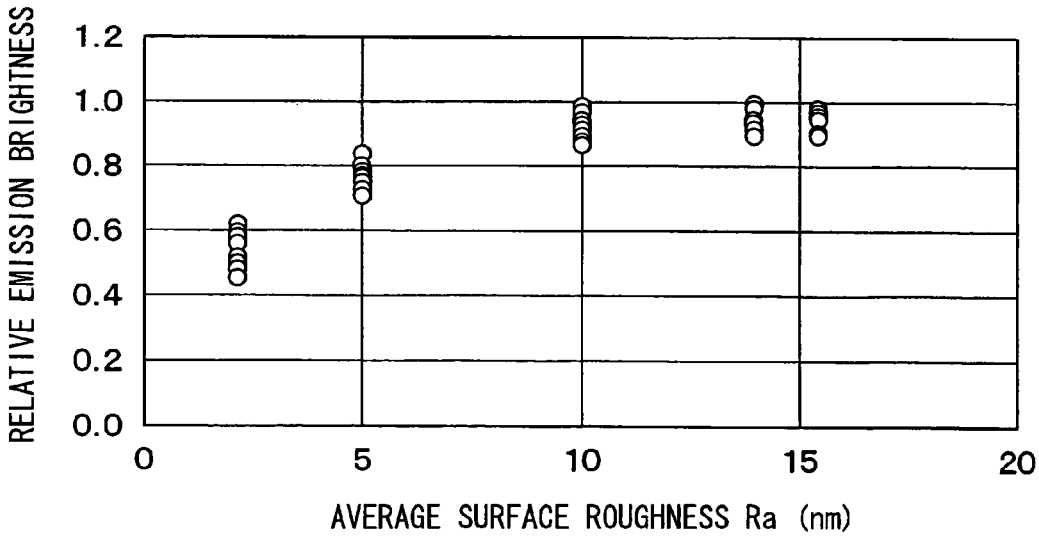
FIG. 6 is a graph showing a relation between an average surface roughness Ra of an emission layer and the relative emission brightness.
Figure 7:
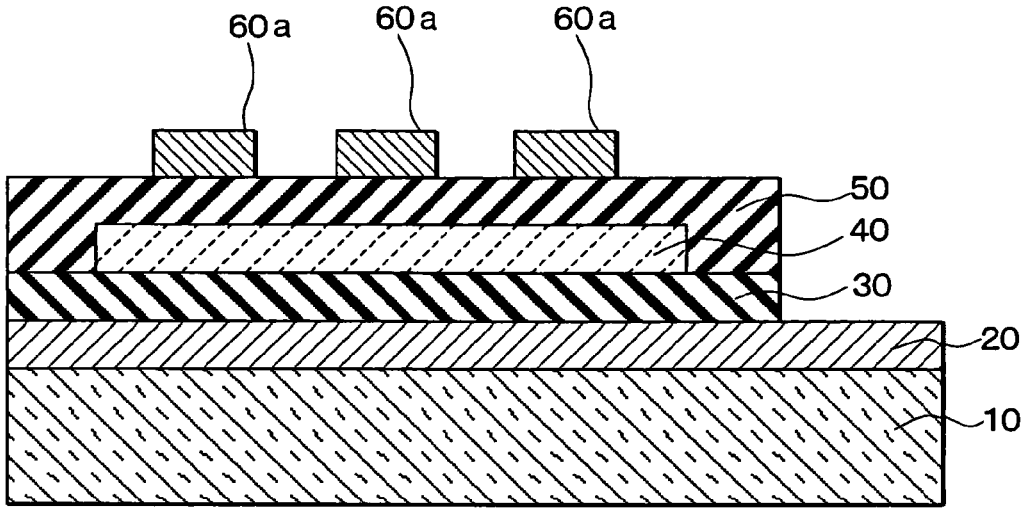
FIG. 7 RELATED ART
FIG. 7 is a schematic cross-sectional view of an inorganic EL display device in a related art.

This can be seen in FIG. 6, which shows a relation between an average surface roughness Ra of the emission layer 40 and the emission brightness. In FIG. 6, the open sizes of the holes 61 are 12 μm.

As shown in FIG. 6, the relative emission brightness becomes smaller as the average surface roughness Ra of the emission layer 40 becomes smaller.

It is considered that this comes from the fact that a degree of scattering of the light at the holes 61 becomes smaller as the surface roughness Ra becomes smaller. In the case that the average surface roughness Ra of the emission layer 40 is larger than 10 nm, the total area of the emission pixels 70 can be reduced without substantially reducing the emission brightness of the emission pixels 70, thereby the amount of the power consumption of the emission pixels 70 can be reduced.

OTHER EMBODIMENTS

The present invention should not be limited to the embodiment discussed above and shown in the figures, but may be implemented in various ways without departing from the spirit of the invention.

For example, holes penetrating in a thickness direction of the inorganic EL display device 100, such as the holes 61 on second electrodes 60 in the above embodiment, may be formed in the first electrodes 20. These holes may be formed in both the first electrodes 20 and the second electrodes 60.

The holes 61 may be arranged, for example, in a zigzag pattern, a spiral pattern, or a concentric pattern. The holes 61 are needed to be arranged regularly in a predetermined pattern. Thus, the holes 61 formed in the electrodes 20, 60 in the present invention are clearly different from pinholes accidentally formed during a manufacturing process.

In the inorganic EL display device 100 shown in FIG. 1, the first insulator layer 30 is provided between the emission layer 40 and the first electrodes 20, and the second insulator layer 50 is provided between the emission layer 40 and the second electrodes 60, in order to, for example, protect the emission layer 40. Either of the first and second insulator layers 30 and 50, however, may be disused. In addition, both the first and second insulator layers 30 and 50 may be disused.

One of the first electrode 20 and the second electrode 60 in an emission pixel 70 may be optically opaque. In the case that one of the electrodes 20 and 60 is optically transparent and the other one is optically opaque, the light can be seen only through the transparent electrode 20 or 60.

The emission pixels 70 may be arranged in a segment displaying pattern. In this case, a character (such as a numeral "3" or a numeral "8") is expressed by a combination of multiple segments, each of which corresponds to an emission pixel. In the segment displaying pattern, the multiple segments are aligned along a line drawing (such as a numeral "8") in which one or more numeral can be fitted.

The first electrodes 20, the first insulator layer 30, the emission layer 40, the second insulator layer 50, and the second electrodes 60 may have different structures from the above embodiments.

The self-luminous display device of the present invention is not limited to be used for the inorganic EL display device 100 described in the above embodiment. The self-luminous display device may be implemented as a plasma display device or an organic EL display.

What is claimed is:

1. A self-luminous display device, comprising:

an emission pixel including a pair of electrodes and a light emission unit inserted between the pair of the electrodes, wherein the light emission unit is an inorganic EL element mainly made of an inorganic EL material, wherein the light emission unit emits light when an electric voltage is applied to the pair of electrodes, wherein holes are defined and positioned in a predetermined pattern in at least one of the electrodes, wherein the pair of electrodes are located to orthogonally cross with each other to define an intersection area, the emission pixel is positioned in the intersection area, and the holes are provided in the emission pixel within the intersection area;

wherein an average open size of the holes is equal to or below 50 μm;

wherein a total area of the emission pixel excluding areas of the holes is equal to or more than 25% of a total area of the emission pixel including the areas of the holes; and wherein a surface roughness of the emission unit is equal to or more than 10 nm wherein the at least one of the electrodes in which the holes are defined is optically transparent and is located on a light emitting side.

2. The self-luminous display device according to claim 1, wherein the holes are arranged in a regular pattern in at least one of the electrodes.

3. A self-luminous display device according to claim 1, wherein the average open size of the holes is equal to or below 20 μm.

4. The self-luminous display device of claim 1 wherein the holes provided in the emission pixel within each intersection area are positioned separate from each other.

5. The self-luminous display device of claim 1 wherein the holes each have the shape of a circle.

6. The self-luminous display device according to claim 1, wherein the holes are defined and positioned in a predetermined pattern in both of said pair of electrodes.

7. The self-luminous display device according to claim 6, wherein both of said pair of electrodes are transparent.

8. The self-luminous display device according to claim 1, wherein said holes are defined and positioned to penetrate the at one of the electrodes in a thickness direction of the at least one of the electrodes.

9. A self-luminous display device comprising:

a pair of first and second electrodes; and a light emission unit inserted between the first and second electrodes, the light emission unit being mainly made of an inorganic EL material and emitting light when an electric voltage is applied to the pair of first and second electrodes; wherein:

the first and second electrodes and the light emission unit are disposed to form a plurality of emission pixels arranged in a segment displaying pattern;

at least one of the first and second electrodes has holes arranged in a predetermined pattern in each of the emission pixels;

the pair of first and second electrodes are located to cross with each other to define intersection areas, each of the emission pixels arranged in the segment displaying pattern is positioned in the intersection area, and the holes are provided in the emission pixel within the intersection area;

wherein an average open size of the holes is equal to or below 50 μm;

wherein a total area of each of the emission pixels excluding areas of the holes is equal to or more than 25% of a total area of each of the emission pixels including the areas of the holes; and wherein a surface roughness of the emission unit is equal to or more than 10 nm wherein said at least one of the first and second electrodes having said holes is optically transparent and is located on a light emitting side.

10. The self-luminous display device according to claim 9, wherein:

the first electrode includes a plurality of electrode plate parts arranged at one side of the emission unit;

the second electrode includes a plurality of electrode plate parts arranged at the other side of the emission unit; and the electrode plate parts of the first and second electrodes are arranged to define the plurality of emission pixels.

11. The self-luminous display device according to claim 9, wherein the holes are through holes penetrating through one of the first and second electrodes in each emission pixel.

12. The self-luminous display device of claim 9 wherein the average open size of the holes is equal to or below 20 μm.

13. The self-luminous display device of claim 9 wherein the holes provided in the emission pixel within each intersection area are positioned separate from each other.

14. The self-luminous display device of claim 9 wherein the holes each have the shape of a circle.

15. The self-luminous display device according to claim 9, wherein the holes are arranged in a predetermined pattern in both of said first and second electrodes.

16. The self-luminous display device according to claim 15, wherein both of said first and second electrodes are transparent.

17. The self-luminous display device according to claim 9, wherein said holes are arranged to penetrate the at least one of the first and second electrodes in a thickness direction of the at least one of the first and second electrodes.

18. A self-luminous display device comprising:

a pair of first and second electrodes; and a light emission unit inserted between the first and second electrodes, the light emission unit being mainly made of an inorganic EL material and emitting light when an electric voltage is applied to the pair of first and second electrodes; wherein:

the first and second electrodes and the light emission unit are disposed to form a plurality of emission pixels arranged in a dot-matrix displaying pattern;

at least one of the first and second electrodes has holes arranged in a predetermined pattern in each of the emission pixels; and the pair of first and second electrodes are located to orthogonally cross with each other to define intersection areas, each of the emission pixels arranged in the dot-matrix displaying pattern is positioned in the intersection area, and the holes are provided in the emission pixel within the intersection area;

an average open size of the holes is equal to or below 50 μm;

a total area of each of the emission pixels excluding areas of the holes is equal to or more than 25% of a total area of each of the emission pixels including the areas of the holes; and a surface roughness of the emission unit is equal to or more than 10 nm wherein said at least one of the first and second electrodes having said holes is optically transparent and is located on a light emitting side.

19. The self-luminous display device of claim 18 wherein the average open size of the holes is equal to or below 20 μm.

20. The self-luminous display device of claim 18 wherein the holes provided in the emission pixel within each intersection area are positioned separate from each other.

21. The self-luminous display device of claim 18 wherein the holes each have the shape of a circle.

22. The self-luminous display device according to claim 18, wherein the holes are arranged in a predetermined pattern in both of said first and second electrodes.

23. The self-luminous display device according to claim 22, wherein both of said first and second electrodes are transparent.

24. The self-luminous display device according to claim 18, wherein said holes are arranged to penetrate the at least one of the first and second electrodes in a thickness direction of the at least one of the first and second electrodes.

25. A self-luminous display device, comprising:

a first group of electrodes extending longitudinally in a first direction;

a second group of electrodes extending longitudinally in a second direction which is perpendicular to the first direction, each consecutive electrodes of the second group of electrodes having a longitudinal space separating the consecutive electrodes, and each of electrodes of the second group of electrodes having a plurality of holes defined therein in a predetermined pattern; and a plurality of emission pixels respectively positioned between overlapping portions of the first and second groups of electrodes, each of the emission pixels including an emission layer composed mainly of an inorganic EL material;

wherein the holes in the electrodes of the second group of electrodes are positioned in respective portions of the electrodes of the second group of electrodes which overlap with electrodes of the first group of electrodes; and wherein at least one of the electrodes is optically transparent, is located on a light emitting side, and has holes defined therein.

26. The self-luminous display device of claim 25 wherein the average open size of the holes is equal to or below 20 μm.

27. The self-luminous display device of claim 25 wherein the holes each have the shape of a circle.

28. The self-luminous display device of claim 25 wherein the first electrodes are positioned on a glass substrate which is positioned on one side of the emission layer, and the second electrodes are positioned on the other side of the emission layer.

29. The self-luminous display device of claim 25 wherein:

an average open size of the holes is equal to or below 50 μm;

a total area of each of the emission pixels excluding areas of the holes is equal to or more than 25% of a total area of each of the emission pixels including the areas of the holes; and a surface roughness of the emission unit is equal to or more than 10 nm.

30. The self-luminous display device of claim 25, wherein at least one of the electrodes of the first group of electrodes is optically transparent and at least one of the electrodes of the second group of electrodes is optically transparent and both of the optically transparent electrodes have holes defined therein.

* * * * *